US006751933B2

(12) United States Patent
Huss

(10) Patent No.: US 6,751,933 B2
(45) Date of Patent: Jun. 22, 2004

(54) METHOD AND DEVICE FOR TURNING AND RELAXING SPRINGS

(75) Inventor: Werner Huss, Wittenbach (CH)

(73) Assignee: Spuhl AG St. Gallen, Wittenbach (DE)

( * ) Notice: Subject to any disclaimer, the term of this patent is extended or adjusted under 35 U.S.C. 154(b) by 0 days.

(21) Appl. No.: 10/312,109

(22) PCT Filed: Jun. 25, 2001

(86) PCT No.: PCT/CH01/00392

§ 371 (c)(1),
(2), (4) Date: Mar. 18, 2003

(87) PCT Pub. No.: WO02/00545

PCT Pub. Date: Jan. 3, 2002

(65) Prior Publication Data

US 2003/0163977 A1 Sep. 4, 2003

(30) Foreign Application Priority Data

Jun. 27, 2000 (CH) ..... 1267/00

(51) Int. Cl.[7] ..... B65B 63/02
(52) U.S. Cl. ..... 53/436
(58) Field of Search ..... 53/436, 114, 523, 53/527, 428, 524; 29/896.92, 91, 91.1; 140/3 CA

(56) References Cited

U.S. PATENT DOCUMENTS

| | | | | | |
|---|---|---|---|---|---|
| 1,352,157 | A | * | 9/1920 | Suekoff | 53/260 |
| 1,592,838 | A | * | 7/1926 | Rief | 53/114 |
| 1,950,186 | A | * | 3/1934 | Lofman | 53/114 |
| 1,995,641 | A | * | 3/1935 | Kaiser | 53/114 |
| 2,605,947 | A | * | 8/1952 | Stevens | 53/396 |
| 3,441,064 | A | * | 4/1969 | Fischer | 140/3 R |
| 5,603,284 | A | * | 2/1997 | Freedman | 119/28.5 |
| 6,021,627 | A | * | 2/2000 | Mossbeck et al. | 53/438 |
| 6,036,181 | A | * | 3/2000 | Workman | 267/90 |
| 6,523,812 | B1 | * | 2/2003 | Spinks et al. | 267/80 |

* cited by examiner

*Primary Examiner*—Rinaldi I. Rada
*Assistant Examiner*—John Paradiso
(74) *Attorney, Agent, or Firm*—Wood, Herron & Evans, L.L.P.

(57) ABSTRACT

A device and method for turning and relaxing compressed springs in pocket sections of a spring pocket row is provided. The device comprises a push rod having a lower limb and a connection rod. A first linear drive pivots the push rod about a vertical axis and the second linear drive raises and lowers the push rod. During a working stroke the first linear drive pivots the push rod so at least one compressed spring is seized and displaced in a pocket section. The push rod is returned to its original position before the spring pocket row is advanced. The process is then repeated.

14 Claims, 5 Drawing Sheets

METHOD AND DEVICE FOR TURNING AND RELAXING SPRINGS

FIELD OF THE INVENTION

The subject matter of the invention is a method for turning and relaxing springs pressed into a block and applied in a spring pocket row.

The subject-matter of the invention is a method for turning and relaxing springs pressed into a block and applied in a spring pocket row, according to the introductory part of claim 1. The subject-matter is further a device for turning and relaxing springs pressed into a block and applied in a spring pocket row, according to the introductory part of claim 3.

BACKGROUND OF THE INVENTION

Springs for the manufacture of mattresses, cushioned furniture, cushions and likewise may be connected to one another in various manners in order in the connected condition to be covered over with cover materials and a case material. With the present invention it is the case of springs which are applied in rows in textile pockets of cotton material or fleece, so-called spring pocket rows, these spring pocket rows later being mutually connected to one another, e.g., by way of ultrasound are welded or adhesed. After the manufacture of the springs on a spring winding machine these in the axial direction are pressed together to a block, i.e., the spring windings bear completely on one another. In this pressed-together form there is effected the insertion into the spring pocket row which mostly consists of cotton material band or fleece band folded between its longitudinal edges. Before or after the insertion then between the springs coming to lie in a row pressed together there are incorporated or seamed linear weldings so that there arise individual pocket sections. After insertion of the springs the free edges of the pocket material are connected to one another. The pocketed springs then more or less lie held pressed together within the pocket sections or the spring pocket row and for the further processing must be relocated 90° so that they may be least partly relaxed and may assume the usage height.

From EP-A1 0 967 031 there is known a device with which the pocketed, pressed-together springs within the pocket section may be relocated and relaxed. With this known device the spring pocket row along a longitudinal edge of the pocket material is held by a clamping device. Thereafter each individual spring by a propeller-like wing whose horizontally lying axis is arranged above the pressed-together spring is seized by a wing end and the above-lying end ring of the spring is displaced parallel to the seams forming the pocket sections. By way of this the spring may be partly relaxed. As soon as the upper end winding with respect to the lower, stationary end ring has reached a certain distance the spring turns by itself and its axis then lies in the horizontal, i.e. parallel to the weld seams between the individual pocket sections. In another formation of the known device in place of a propeller there is a push finger which is traversable transverse to the spring pockets and which likewise seizes the pressed-together springs at their upper end ring and thus laterally displaces them until the spring by way of the intrinsic tension force turnes by 90°. A further possibility of setting up the springs is a rotating worm whose thread turns achieve the same effect.

The known devices fulfill their object perfectly as long as all movements and the mutual position of the push finger and spring are exactly coordinated to one another and the spring furthermore is not manufactured of a thin wire. Even if for any reason the relocating (in technical language also called setting-up) of the spring is not effected straight away, the spring remains in the initial position and must subsequently be relocated by hand. This makes a perfect method procedure impossible. Furthermore with the rotating worm there exists the danger of damage to the pocket material.

SUMMARY OF THE INVENTION

The object of the present invention is the creation of a method and a device for relocating pocketed springs which ensure that all springs in the pocket sections after running through the device assume the desired position.

This object is achieved by a method with the features of patent claim 1 as well as with a device with the features of patent claim 3.

With the method according to the invention and the device according to the invention one succeeds in a perfect turning of the springs by way of the fact that each spring moves into the active region of the rod with which the spring is set up, not only once but several times. At the same time it is not important whether the spring lies exactly in the middle of the pocket section or not. It is also not important which geometric shape the end rings have. If in the spring pocket rows there are present empty pockets whose width may be unequal to the filled pockets, by way of these position displacements there occur no problems on setting up the springs in the neighboring pockets. Furthermore damage to the pocket material may be prevented since the rod laterally seizes the spring and there are always exerted only the forces necessary for the turning, these being distributed over a large surface onto the springs and onto the textile pocket material lying between the spring and the rod. The method may be retrospectively installed into existing pocket spring machines and has only a few parts which are maintenance-free and which may be adapted to the springs to be machined with little effort. With conventional devices with push fingers the drive of the latter may be directly used for the drive of the push rod. A retrofitting is possible with little effort.

BRIEF DESCRIPTION OF THE DRAWINGS

By way of illustrated embodiment examples the invention is described in more detail. There is shown in FIG. 1 is a perspective representation of a spring pocket row with six pressed-together springs after insertion into the spring pocket sections and the already relocated (set-up) springs (pivot rod directly before pivoting movement)

DETAILED DESCRIPTION OF THE INVENTION

Figure 1:
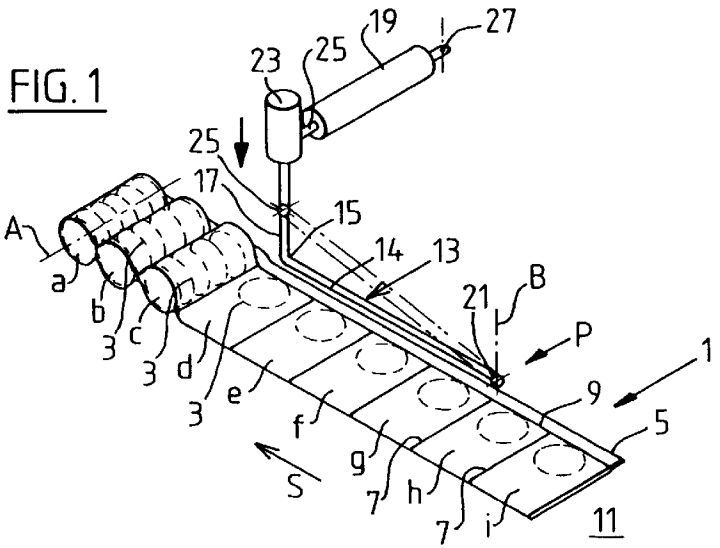

The cutout shown schematically in FIG. 1 shows a spring pocket row 1 in which on the right side in pocket sections there lie six springs 3 which are in each case pressed together into a block. They assume this position after they have been inserted by a suitably designed known insert device in the direction of the arrow P in the pocket sections a, b, c, d, e, f, g, h,; initially open along the edge 5. Between the individual springs 3 the spring pocket row 1 is divided into a multitude of pocket sections by seams, for example by way of seams 7 welded by ultrasound or manufactured with a sewing machine. After the insertion of the pressed-together springs 3 the open side of the pocket sections are closed by a seam 9 running parallel to the row 1. The three springs 3 shown on the left side have already been turned by 90° by way of a spring setting-up or spring-turning device. The axes of symmetry A of these springs 3 now lie turned by 90° to the initial position. The spring pocket row I is advanced in the direction of the arrow 2 in steps on a rest and transport surface 11 by way of means not shown. The insertion of the springs pressed together to a block is effected, not shown in the Figures, on the right side of the Figures. The pressed-together springs which then lie within the pocket sections and whose axes lie perpendicular to the transport surface by way of the advance steps get into the region of a push rod 13 which is arranged laterally to the edge 5 and whose lower limb 14 in the initial position lies parallel to the edge 5 and extends over the length of several pocket sections. The push rod 13 at its end 21 is pivotably linked about an axis B. The other end 15 is fastened on a connection rod 17 which creates a connection to a first linear drive 19 which permits a horizontal pivoting movement of the push rod 13 about the axis B. A second linear drive 23 which is connected to the end of the drive rod 25 of the first linear drive 19 permits a vertical movement of the push rod 13. A linked connection 26 between the drive rod of the second linear drive 23 to the connection rod 17 permits the movability required for setting up the springs 4.

Figure 9:
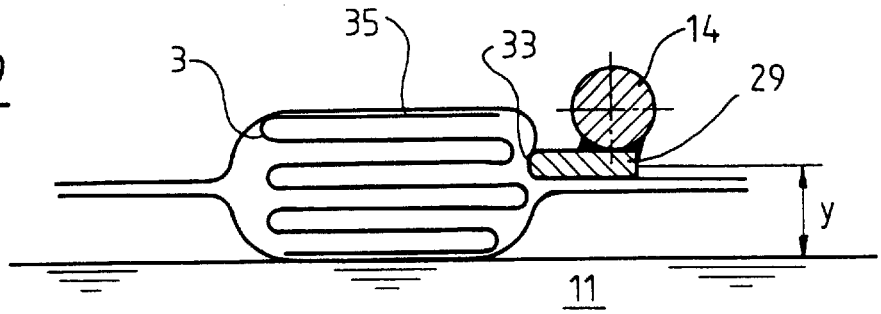
FIG. 9 is a cross section through the spring pocket row and the pivot rod at the beginning of the pivot movement.
Figure 10:
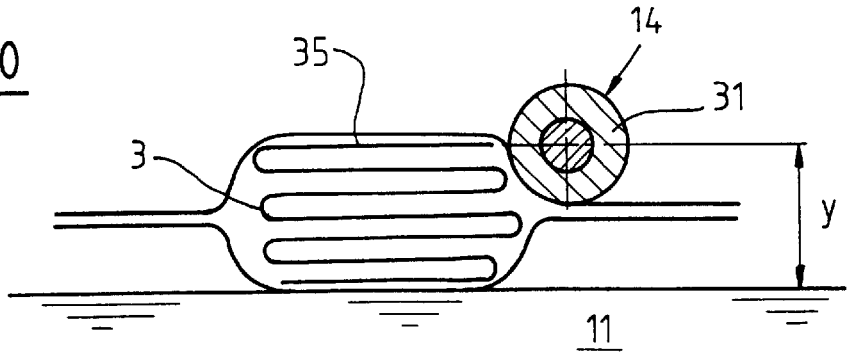
FIG. 10 is a cross section through a spring pocket row with a pivot rod of a further formation of the invention at the beginning of the pivoting movement.
Figure 11:
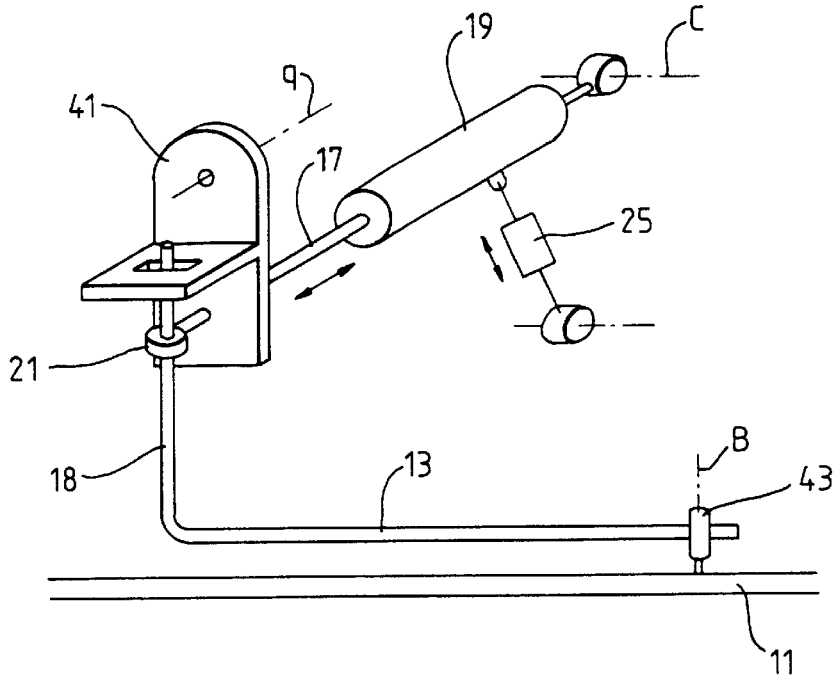
FIG. 11 is a perspective representation of a rod drive with which the linear drive is only pivotable in the vertical direction.
Figure 12:
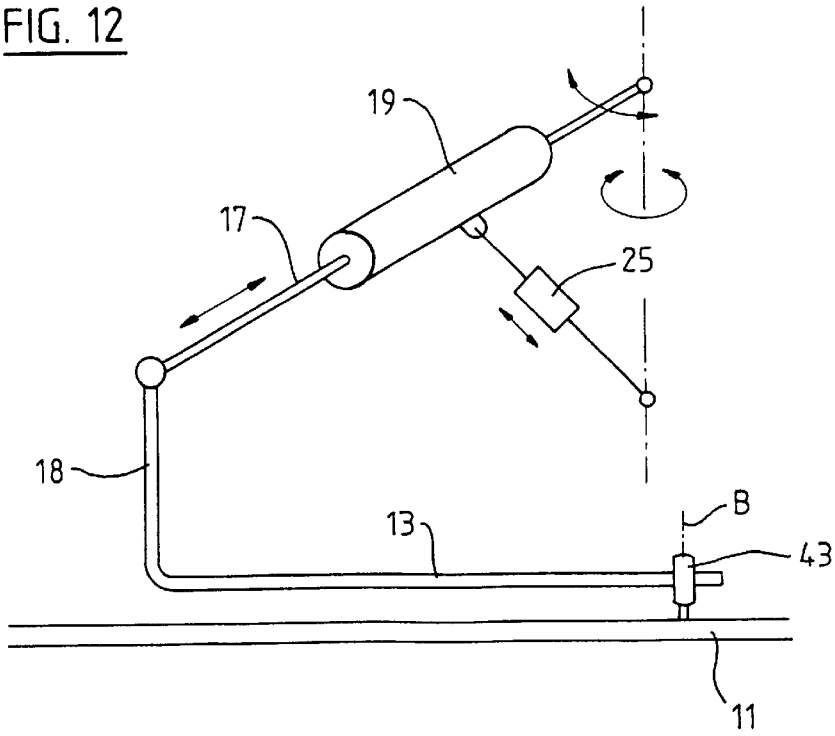
FIG. 12 is a perspective representation of the rod drive, with which the linear drive is pivotably linked in the vertical as well as horizontal direction.
Figure 13:
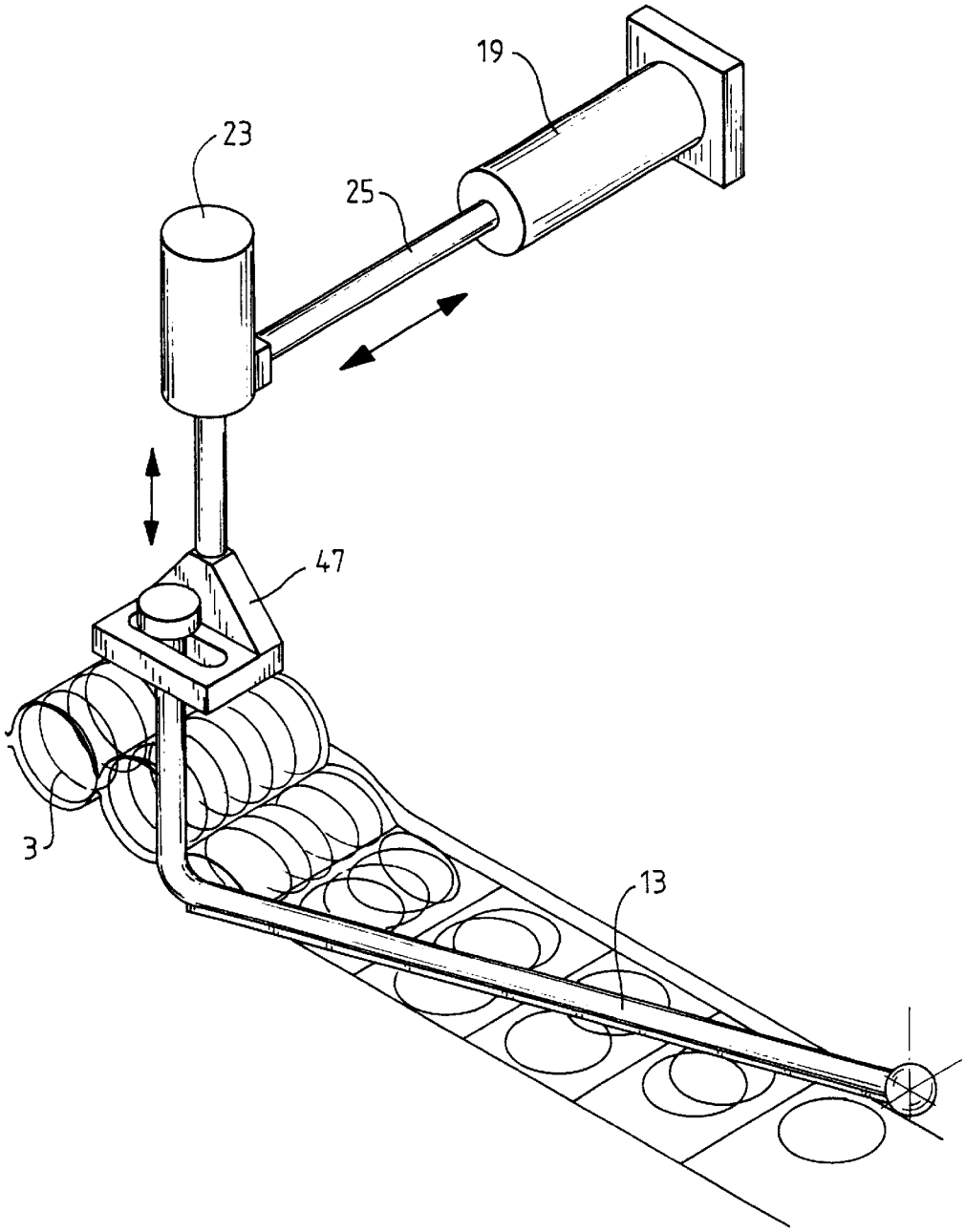
FIG. 13 is a perspective representation of a further embodiment form of the drive for the push rod.

In the first embodiment example of the invention the linear drive 19 at its end 27 distant to the push rod 13 is linkedly connected to the machine frame (not shown). In the idle position (broken lines) the lower limb 14 of the rod 13 lies parallel to the edge 5 of the spring pocket 1 and inclined at an acute angle to the plane of the transport surface 11. At the beginning of the now subsequently described setting-up procedure according to FIG. 1 already three springs lie in their final position (horizontal axis A) in the pocket sections a, b, c. To these three springs 3 there connect the pocket section d-i in which the springs are still pressed together as a block. The push rod 13 or its lower-lying limb 14 by way of the second linear drive 23 has been traversed into the working position in which the lower limb 14 now lies parallel or essentially parallel to the transport surface 11 (compare cross-sections according to FIGS. 9 and 10). The limb 14 of the push rod 13 and a profile 29 fastened on the limb 14 or a sleeve 31 rotatably fastened on the rod lie at a distance Y to the transport surface 11. The distance is dimensioned such that the front edge 33 of the profile 29 or the front apex of the sleeve 31 lies below the upper end ring 35 of the spring 3.

Figure 3:
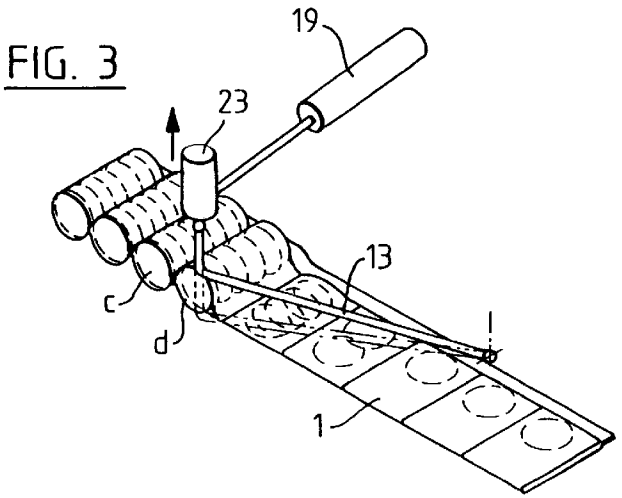
FIG. 3 is a perspective representation of a spring pocket row after the pivoting up of the pivot rod and the beginning of the advance of the spring pocket row.
Figure 2:
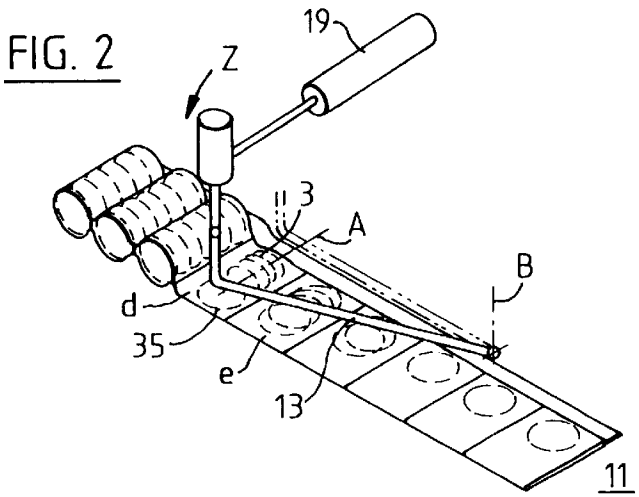
FIG. 2 is a perspective representation of a spring pocket row during the setting-up of the springs (pivot rod shortly before the end of the pivoting movement)

During the working stroke (FIG. 2) the first linear drive 19 now pivots the rod 13 about the axis B (arrow direction Z). With this the spring 3 which is located in the pocket section d is seized on or below its end ring 35 and is displaced transversly to the pocket row 1. Now the spring 3 tilts within the pocket section d and is relaxed so that its axis at the end of the pivoting procedure lies horizontally or parallel to the transport surface 11. The neighboring spring 3 in the pocket section e is likewise seized by the rod 13, but possibly not completely tilted over. If it has only been partly seized then possibly when the rod 13 moves up (FIG. 3) it will return back into the initial pressed-together position. This is however not important since with the next advance of the push rod 13 which is effected after the pocked spring row has been advanced by a pocket section width, spring 3 is seized once again and as previously the spring 3 is set up in the pocket section d.

Figure 4:
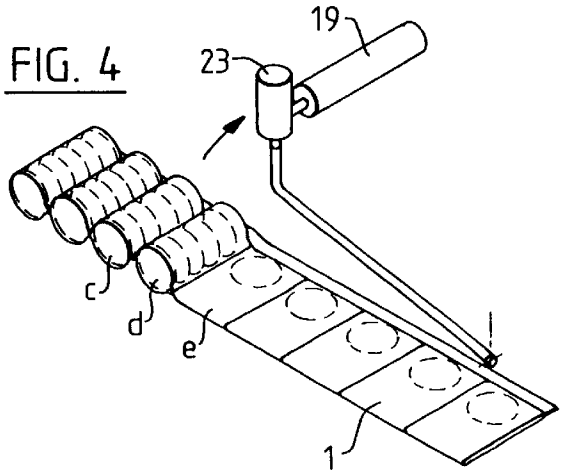
FIG. 4 is a perspective representation of the spring pocket row after pivoting back the pivot rod into the initial position (the spring pocket row has been advanced by one position)

So that rod 13 may return back into the initial position, as already mentioned it is lifted at the end of the first working stroke by the second linear drive 23 and is guided back by the first linear drive 19 into the initial position (compare FIG. 4). Now the advance of the pocket spring row may be effected.

During the pivoting of the rod 3 the pocket spring row 1 on its edge 5 is held firm by way of an inclined means which is not shown, in order to avoid a displacement on the transport surface 13.

Figure 5:
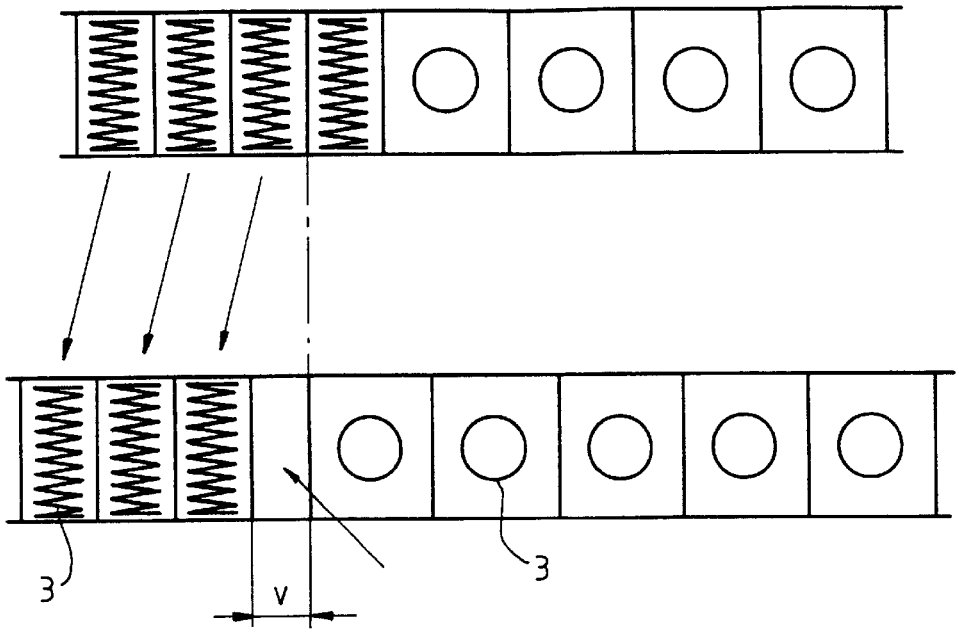
FIG. 5 is a schematic representation (plan view) of the spring pocket row without any empty pocket (above) and a spring pocket row with an empty pocket (below)

Spring interior mattresses may have varying widths. This means that in the pocket spring row 1 a varying number of pocket springs 3 or pocket spring sections are present. Also the diameter of the springs 3 is different according to the design of the spring interior. At the end of such a spring pocket row 1 coordinated to the width of the spring interior either a pocket section is left empty or preferably a narrower empty section is produced. In particular by way of the production of a narrower section (empty pocket) there results a position displacement between the push rod 13 and the position of the spring 3 with respect to the push rod 13. This displacement may either be alleviated by way of a suitable correction of the advance or one may do away with it since the push rod 13 according to the invention is likewise capable of setting up springs 3 which do not always lie at exactly the same location. From FIG. 5 it is clearly evident how such a displacement is effected and how it has an effect on the distance of the two neighboring springs 3.

Figure 6:
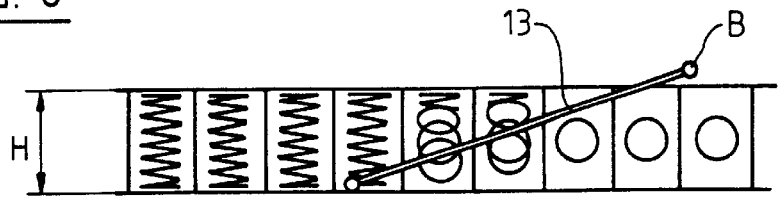
FIG. 6 is a plan view (schematic) of a spring pocket row with a pivoted-out pivot rod.
Figure 7:
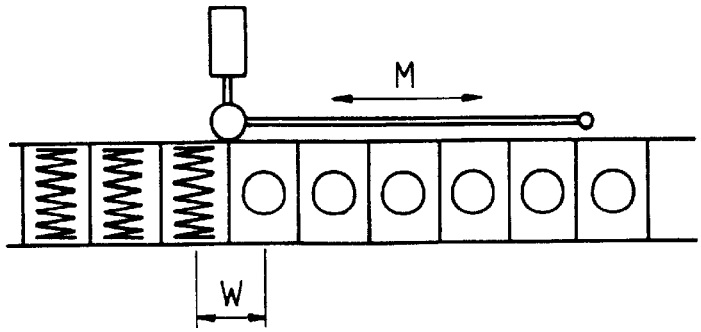
FIG. 7 is a plan view (schematic) of a spring pocket row with the pivot rod in the initial position.
Figure 8:
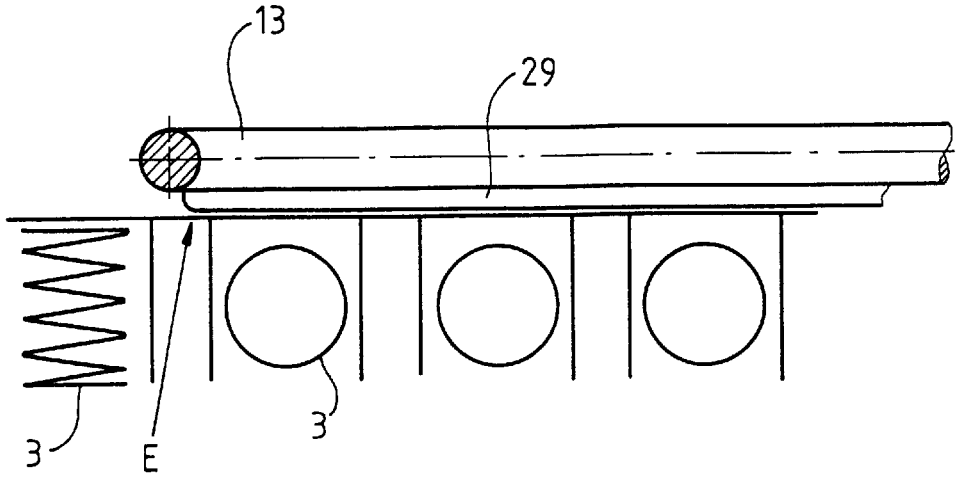
FIG. 8 is a plan view (schematic) of a spring pocket row, but with an enlarged representation of the pivot rod.

In the FIGS. 6 and 7 it is shown how simply the setting-up device, i.e. the push rod 13 is adjustable to the conditions, i.e., the distance W between the individual springs 3 or spring pocket sections (FIG. 7) of their height H. The adjustment of the insert device with a change of the distance W is effected by way of a simple displacement along the arrows M, the setting of the device to the height H of the spring 3 is effected by the stroke of the first linear drive 19 which has the effect of a change of the pivoting angle of the rod 13 about the axis B. Preferably the front end E of the rod 13 or of the roller 31 or of the profile 29 is located between two springs 3. With this it may be achieved that the spring 3 does not catch on the edge E. Furthermore the damage to the pocket material is further reduced.

What is claimed is:

1. A method for turning and relaxing springs pressed together into a block and applied in pocket sections of a spring pocket row for the manufacture of spring pockets for mattresses and likewise, said method comprising the following steps:

stopping and securing along a longitudinal edge the spring pocket row;

pivoting an L-shaped rod having a lower limb initially located laterally of the spring pocket row to a position in which the lower limb extends over several pocketed springs; and seizing upper lying end rings of the springs, the springs lying in a pivoting or displacement region of the L-shaped rod and turning the seized end rings within the spring pocket sections.

2. The method of claim 1 further comprising lowering the pivoting or displacement region of the L-shaped rod from an idle position to a working position prior to pivoting the L-shaped rod.

3. The method of claim 2 further comprising lifting the pivoting or displacement region of the L-shaped rod and pivoting it back to the idle position after the seized end rings have been turned.

4. A method for turning and relaxing springs pressed together into a block and applied in pocket sections of a spring pocket row for the manufacture of spring pockets for mattresses and likewise, said method comprising the following steps:

placing a spring pocket row on a transport surface, said spring pocket row being divided into a plurality of pocket sections by seams, each of said pocket sections having an open side;

inserting into each of said pocket sections a spring pressed together into a block;

closing the open sides of the pocket sections;

lowering a push rod from an idle position in which a lower limb of the push rod lies parallel to the edge of the spring pocket and inclined at an acute angle to the plane of the transport surface to a working position in which the lower limb of the push rod lies parallel to the transport surface;

horizontally pivoting the push rod about an axis in a working stroke; and seizing at least one spring located in at least one of said pocket sections on or below its upper lying end ring and turning the spring within the spring pocket section during the working stroke.

5. The method of claim 4 further comprising raising the lower limb of the push rod such that the lower limb of the push rod is inclined at an acute angle to the transport surface and pivoting the push rod back to its initial position.

6. The method of claim 5 further comprising advancing the pocketed spring row.

7. The method of claim 4 wherein the push rod is pivoted during the working stroke by a first linear drive.

8. The method of claim 7 wherein the lower limb of the push rod is moved between its idle and working positions by a second linear drive.

9. A method for turning and relaxing springs pressed together into a block and applied in pocket sections of a spring pocket row for the manufacture of spring pockets for mattresses and likewise, said method comprising the following steps:

placing a spring pocket row on a transport surface, said spring pocket row being divided into a plurality of pocket sections by seams, each of said pocket sections having a spring pressed together into a block therein;

lowering a push rod from an idle position in which a lower limb of the push rod lies parallel to the edge of the spring pocket and inclined at an acute angle to the plane of the transport surface to a working position in which the lower limb of the push rod lies parallel to the transport surface;

horizontally pivoting the push rod about an axis in a working stroke; and seizing at least one spring located in at least one of said pocket sections on or below its upper lying end ring and turning the spring within the spring pocket section during the working stroke.

10. The method of claim 9 further comprising raising the lower limb of the push rod such that the lower limb of the push rod is inclined at an acute angle to the transport surface and pivoting the push rod back to its initial position.

11. The method of claim 10 further comprising advancing the pocketed spring row before performing another working stroke with the push rod.

12. A device for turning and relaxing springs pressed together into a block and applied in pocket sections of a spring pocket row lying on a transport surface for the manufacture of spring pockets for mattresses and likewise, said device comprising:

a first linear drive for moving a first drive rod; and a second linear drive for moving a second drive rod, said second drive linear drive being connected to a front end of the first drive rod, said second drive rod being operatively coupled to a connection rod of an L-shaped push rod, said L-shaped push rod having a lower limb extending generally perpendicular to said connection rod, wherein said L-shaped push rod is movable from an initial position in which the lower limb of the L-shaped push rod lies parallel to an edge of the spring pocket and inclined at an acute angle to the plane of the transport surface to a working position in which the lower limb of the L-shaped push rod lies parallel to the transport surface upon activation of said second linear drive and said lower limb of the L-shaped push rod is pivotable about an axis via activation of said first linear drive to seize and turn upper lying end rings of the springs within the spring pocket sections.

13. The device of claim 12 wherein a profile rail is formed on the lower limb of the push rod.

14. The device of claim 12 wherein a tubular roller is gripped around the lower limb of the push rod.

* * * * *